United States Patent [19]

Keller

[11] 4,341,933

[45] Jul. 27, 1982

[54] METHOD AND APPARATUS FOR EXTINGUISHING AN ELECTRIC ARC IN A CIRCUIT BREAKER

[75] Inventor: Jakob Keller, Fislisbach, Switzerland

[73] Assignee: BBC Brown, Boveri & Company, Ltd., Baden, Switzerland

[21] Appl. No.: 105,737

[22] Filed: Dec. 20, 1979

[30] Foreign Application Priority Data

Dec. 20, 1978 [CH] Switzerland ..... 12924/78

[51] Int. Cl.[3] ..... H01H 33/70

[52] U.S. Cl. ..... 200/148 R

[58] Field of Search ..... 200/148 R

[56] References Cited

U.S. PATENT DOCUMENTS 2,297,818 10/1942 Van Sickle ..... 200/148 R 2,399,412 4/1946 Webb ..... 200/148 R

*Primary Examiner*—Robert S. Macon

*Attorney, Agent, or Firm*—Burns, Doane, Swecker & Mathis

[57] ABSTRACT

A method and apparatus for extinguishing an electric arc in a circuit breaker is disclosed which is applicable to circuit breakers in which a gaseous extinguishing medium, such as compressed air or sulfur hexafluoride, is used. The apparatus includes a flow resistance element which alters the flow resistance along the stream of extinguishing medium introduced into the region between the electrical contacts of the circuit breaker in which the electric arc is drawn during the opening operation of the circuit breaker. The flow resistance is altered such that the flow resistance in the vicinity of the theoretical stagnation streamline at the outlet of the flow resistance element is less than the flow resistance at the inlet of the flow resistance element. Consequently, the velocity distribution of the gaseous extinguishing medium is altered such that downstream of the flow resistance element the medium has a velocity profile that includes a core flow of relatively high velocity and a casing flow of relatively lower velocity. Sonic surfaces are produced and positioned relative to the separated electrical contacts and the electric arc drawn between the contacts so as to subject a greater portion of the electric arc to a supersonic stream of extinguishing medium than is the case with conventional circuit breakers.

15 Claims, 6 Drawing Figures

METHOD AND APPARATUS FOR EXTINGUISHING AN ELECTRIC ARC IN A CIRCUIT BREAKER

BACKGROUND OF THE INVENTION

This invention relates generally to electric circuit breakers, and more particularly to a method and apparatus for extinguishing an electric arc produced between the electrical contacts of a circuit breaker during the opening operation, as the contacts separate from each other. The present invention is applicable to circuit breakers in which a gaseous extinguishing medium, such as compressed air or sulfur hexafluoride, is used. For sake of simplicity, however, the description of the present invention will be directed toward a compressed air circuit breaker, that is, toward an air-blast circuit breaker.

In conventional air-blast circuit breakers, a relatively high quantity of the gaseous extinguishing medium is required for reliable extinction of the electric arc produced between the electrical contacts during the opening operation of the circuit breaker.

It is an object of this invention to provide a method and apparatus for the reliable extinction of such an electric arc in which a relatively lesser quantity of the gaseous extinguishing medium is required.

SUMMARY

According to a preferred embodiment of the present invention, the air-blast circuit breaker includes a pair of electrical contacts mounted within a chamber of a hollow, electrical insulator. The gaseous extinguishing medium is delivered to the chamber through an inlet canal included in the insulator. The inlet canal directs the gaseous extinguishing medium into the region between the electrical contacts in which an electric arc is drawn during the opening operation of the circuit breaker. As the gaseous extinguishing medium is delivered through the inlet canal and into the chamber of the insulator the gaseous medium is deflected by the geometry of the chamber walls so that it flows parallel to the axis of the electrical contacts.

A flow resistance element is included in the inlet canal which alters the flow resistance in the inlet canal in such a way that the flow resistance in the vicinity of the theoretical stagnation streamline is less than the flow resistance at the inlet of the flow resistance element. The velocity of the extinguishing medium flow in the vicinity of the theoretical stagnation streamline is changed by the flow resistance element such that the difference between (a) the local velocity at a point on the theoretical stagnation streamline and (b) the mean velocity of the velocity profile development at that point exceeds the corresponding difference at the same point in a circuit breaker without the flow resistance element by at least 10% of the mean velocity at that point with the flow resistance element installed (i.e., (b)).

According to a first embodiment of the present invention, the electrical contacts are disposed approximately symmetrically about the theoretical stagnation point when the circuit breaker is in the open position. According to a second embodiment of the present invention, the electrical contacts are disposed asymmetrically about the theoretical stagnation point when the circuit breaker is in the open position, so that one of the electrical contacts is located relatively closer to the theoretical stagnation point than the other contact.

According to the present invention, the flow resistance element causes at least one sonic surface to be formed in the region between the electrical contacts when the circuit breaker is in the open position. The sonic surface extends transversely across the common axis of the separated electrical contacts, and the center portion of the sonic surface is preferably indented toward the theoretical stagnation point. It is preferable that the maximum depth of indentation of the sonic surface, when measured parallel to the common axis of the contacts, is at least 30%, and most preferably at least 60%, of the vertical cross-section of the stream of extinguishing medium flowing parallel to the axis of the contacts at the point of maximum sonic surface indentation.

According to a preferred embodiment of the present invention, at least one flow resistance element is arranged such that it affects the flow of the extinguishing medium over the entire cross-section of the inlet canal. Such an arrangement produces an enlarged high velocity flow of extinguishing medium in the region between the separated electrical contacts.

BRIEF DESCRIPTION OF THE DRAWINGS

The preferred embodiments of the present invention are described with reference to the accompanying drawings wherein like members bear like reference numerals, and wherein.

DETAILED DESCRIPTION OF THE PREFERRED EMBODIMENTS

Figure 1:
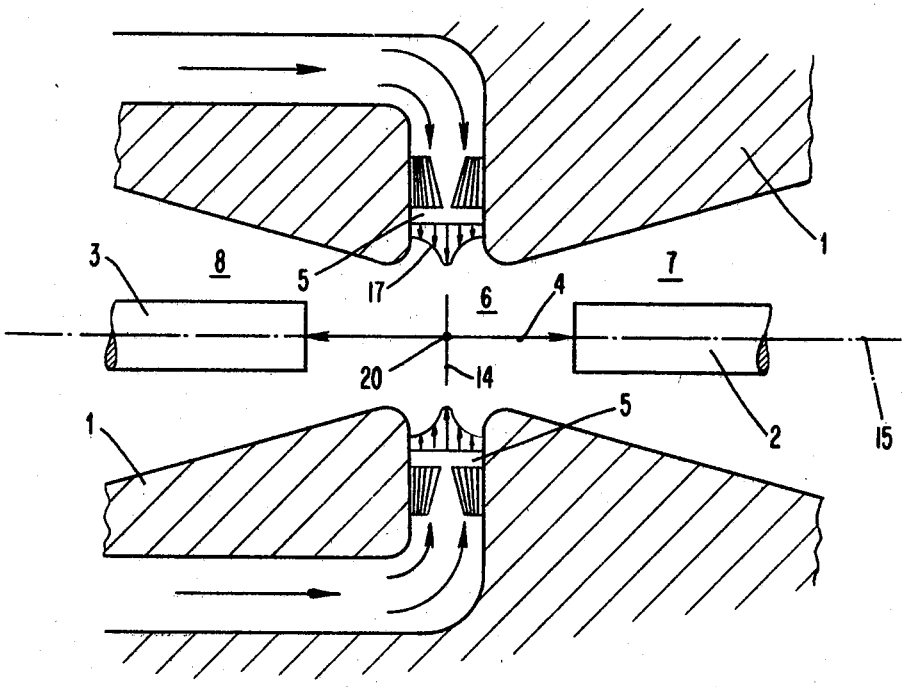
FIG. 1 is a cross-sectional view of an air-blast circuit breaker according to the present invention in which the electrical contacts are illustrated in the open position, and in which velocity profiles are illustrated.

Referring to FIG. 1, an air-blast circuit breaker includes a hollow insulator body 1 of an electrically insulating material. The hollow body encloses a chamber 6 which includes cavities 7, 8. A pair of electrical contacts 2, 3 are included within the chamber 6. The contacts have a common axis 15, and are separated from each other by a distance 4 when the circuit breaker is in the open position.

A gaseous extinguishing medium, such as compressed air or sulfur hexafluoride, is introduced into the chamber 6 through two radially disposed, diametrically opposed circular inlet canals 5, thereby producing opposing streams of extinguishing medium. The boundary surfaces of the cavities 7, 8 act as diffusers for the streams of extinguishing medium. The opposing streams of extinguishing medium are deflected in the contact-separation distance 4 such that the extinguishing medium flows toward the opposing end surfaces of electrical contacts 2, 3.

Figure 1A:
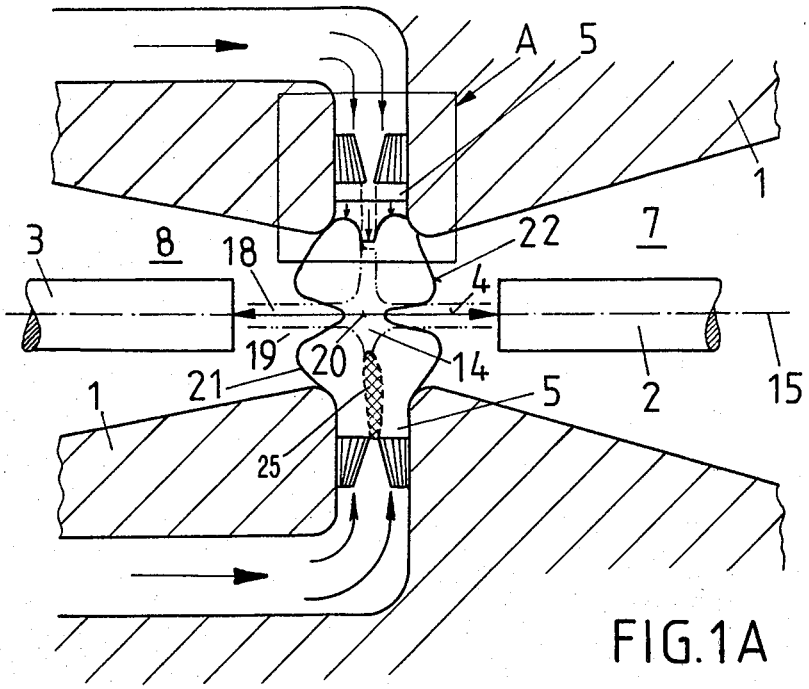
FIG. 1A is a cross-sectional view of the circuit breaker of FIG. 1 in which sonic surfaces are illustrated.

FIG. 1 illustrates a circuit breaker according to the present invention and the velocity profiles developed therein. For the sake of simplicity, only the parts required for an understanding of the present invention are illustrated. FIG. 1A illustrates the circuit breaker of FIG. 1 and includes the sonic surfaces 21, 22 created by the flowing extinguishing medium. The sonic surfaces are the surfaces on which the local velocity is the velocity of sound.

Figure 2:
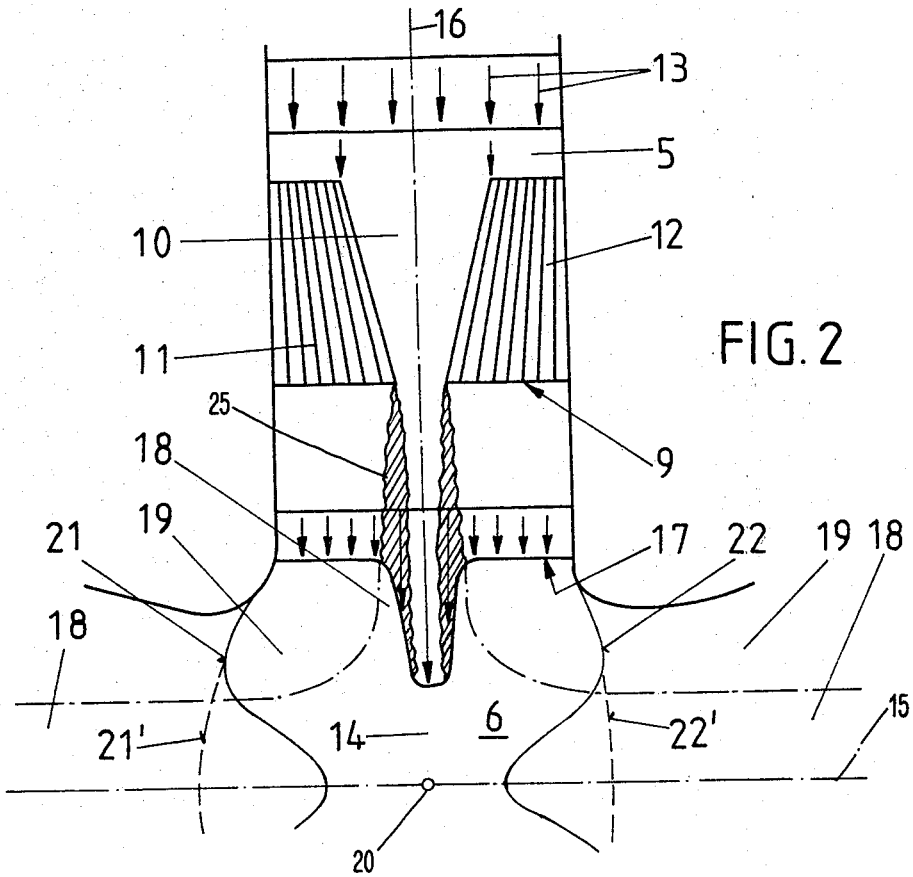
FIG. 2 is an enlarged cross-sectional view of the detail A of FIG. 1A.

With reference to FIG. 2, which is an enlarged cross-sectional view of the detail A of FIG. 1A, a flow resistance element 9 is included in the inlet canal 5. The flow resistance element, which preferably affects the flow of the extinguishing medium over the entire cross-section of the inlet canal, includes a conical nozzle 10 and annular channels 11, 12. Upstream of the flow resistance element, the gaseous extinguishing medium has a substantially uniform velocity distribution which is represented by streamlines 13 and which has a velocity that is substantially equally great everywhere (without consideration of the boundary layer). The flow resistance element alters the velocity distribution of the gaseous extinguishing medium such that downstream of the flow resistance element the gaseous medium has a velocity profile 17 that includes a core flow 18 of higher velocity than a casing flow 19. Additionally, the flow distribution in the central region of the inlet canal is altered such that the mass flow per unit area is increased.

The conical nozzel 10 has a cross-sectional area which decreases from the inlet to the outlet of the flow resistance element 9. The annular channels 11, 12 have cross-sectional areas which increase from the inlet to the outlet of the flow resistance element. Therefore, the flow resistance of the element 9 varies from the inlet to the outlet of the element, and the flow resistance in the vicinity of a theoretical stagnation streamline 14 is less than the flow resistance at the inlet of the element. The extinguishing medium flowing through the conical nozzle 10 is accelerated so as to produce the core flow 18, while the extinguishing medium flowing through the annular channels 11, 12 is decelerated so as to produce the casing flow 19.

During the opening operation of the circuit breaker, as the electrical contacts 2, 3 separate from each other, an electric arc is drawn between the contacts in the contact-separation distance 4. The streaming gaseous extinguishing medium with velocity profile 17 and turbulent shear layer 25, produces two sonic surfaces 21, 22 within the chamber 6 of the circuit breaker. Each of the sonic surfaces extends transversely across the contact-separation distance 4 on opposite sides of a theoretical stagnation point 20. The central portion of each sonic surface, that is the portion of the sonic surface in the vicinity of the axis 15 of the electrical contacts, is indented quite strongly toward the theoretical stagnation point 20 due to the very high velocity of the core flow 18.

A theoretical stagnation point, as used herein, is the theoretical point in space where the local velocity of the flowing medium is zero. In the case illustrated in FIG. 1 of balanced opposing medium flow; the theoretical stagnation point 20 is located on the axis 15 of the electrical contacts. A flow particle would ultimately come to rest at the theoretical stagnation point after following a path herein called the theoretical stagnation streamline 14.

If the flow resistance element 9 were not included in the inlet canal 5 and if a much greater quantity of the gaseous extinguishing medium were supplied to the chamber 6 through the inlet canal 5, sonic surfaces 21', 22', illustrated in FIG. 2 by means of dashed lines, would then exist. As readily seen from FIG. 2, the distance along the axis 15 enclosed by the sonic surfaces 21', 22' is much greater in length than that enclosed by the sonic surfaces 21, 22. The region enclosed between the sonic surfaces, which includes the theoretical stagnation point 20, denotes the region in which the extinguishing medium flows at subsonic velocities. The regions outside the sonic surfaces denote regions in which the extinguishing medium flows at supersonic velocities, at least until the extinguishing medium encounters an obstacle. Thus, the present invention increases the region within the contact-separation distance 4 in which the gaseous extinguishing medium flows at supersonic velocities. This results in a greater portion of the electric arc being subjected to a supersonic stream of extinguishing medium, thereby facilitating arc extinction.

The embodiment illustrated in FIGS. 1, 1A and 2 provides for an approximate doubling of the size of the region in the contact-separation distance 4 in which the extinguishing medium flows at supersonic velocities. Moreover, this approximate doubling is accomplished with a reduction in the overall throughput mass flow of the gaseous extinguishing medium. In order to have an equally large region within the contact-separation distance 4 in which the extinguishing medium flows at supersonic velocities without the use of the flow resistance element 9, the flow cross-section would have to be greater, and therefore a considerably greater quantity of extinguishing medium would have to be delivered through the inlet canal 5.

The embodiment illustrated in FIGS. 1, 1A and 2 includes electrical contacts 2, 3, which when fully separated, are substantially symmetrically disposed on either side of the center line 16 of the inlet canal 5. The axis 15 of the electrical contacts is perpendicular to the center line 16. The flow resistance element 9 is substantially coaxially situated within the inlet canal 5. Consequentially, the extinguishing medium delivered to the chamber 6 through the inlet canal 5 flows substantially symmetrically into the cavities 7, 8, and produces two sonic surfaces 21, 22 that are substantially symmetrically disposed on either side of the center line 16.

Figure 3:
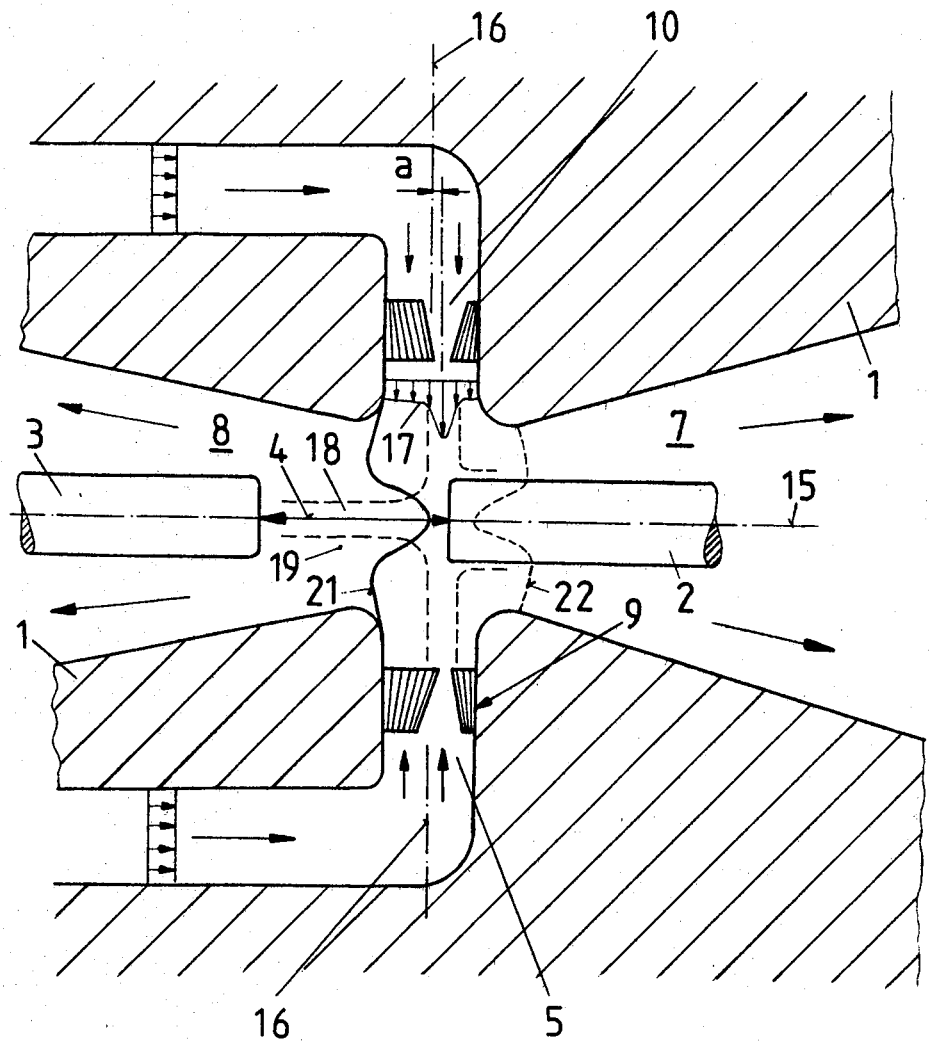
FIG. 3 is a cross-sectional view of another embodiment of a circuit breaker according to the present invention in which the electrical contacts are disposed asymmetrically with respect to the inlet canal.

Referring to FIG. 3, another embodiment of the present invention is illustrated in which the electrical contacts 2, 3 are, when fully separated, arranged asymmetrically with respect to the center line 16 of the inlet canal 5. The axis 15 of the electrical contacts is once again perpendicular to the center line 16. In this embodiment, the conical nozzle 10 is laterally displaced by an amount a with respect to the center line 16 of the inlet canal. The resulting sonic surface 21 included in the contact-separation distance 4 has an indentation directed toward the theoretical stagnation point that is indented so far toward the end surface of the electrical contact 2 that practically the entire contact-separation distance 4 is located within the supersonic velocity region of the extinguishing medium stream. This would, of course, not be the case if the nozzle 10 were coaxially situated within the inlet canal 5. This embodiment once again develops a very high velocity core flow 18 and a significantly lower velocity casing flow 19.

Figure 4:
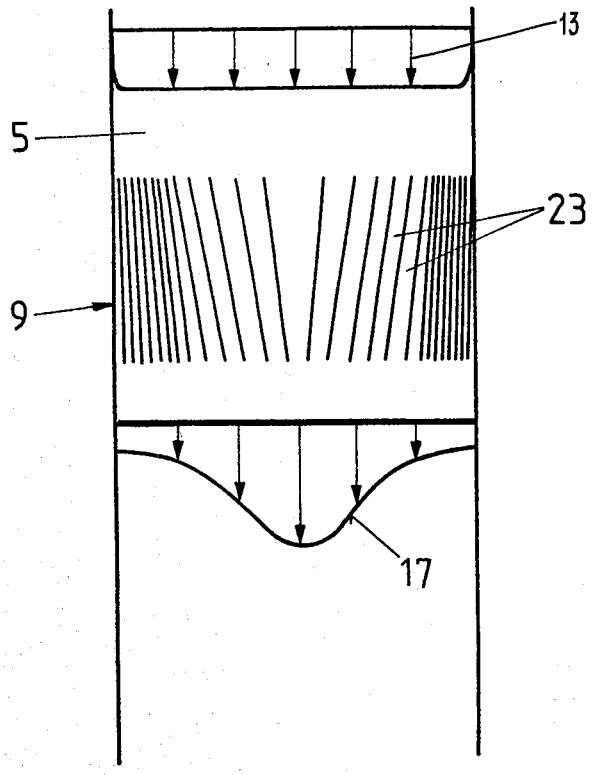
FIGS. 4 and 5 are cross-sectional views illustrating various flow resistance elements according to the present invention.
Figure 5:
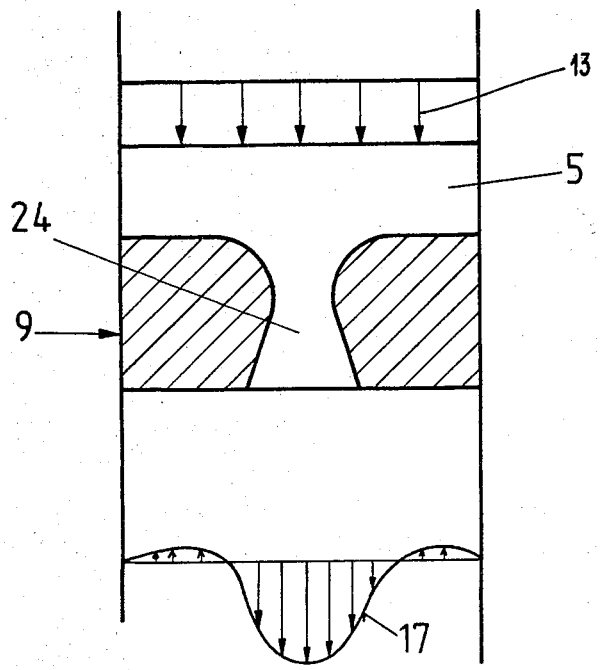

Referring to FIGS. 4 and 5, alternate embodiments of the flow resistance element 9 are illustrated. FIG. 4 illustrates a flow resistance element which includes nozzle and diffuser elements 23 of various sizes. The elements 23 transform the gaseous extinguishing medium from an inlet flow having a substantially uniform velocity profile which is represented by streamlines 13 and which has a velocity that is substantially equally great everywhere, into a downstream flow having a velocity profile 17 with an accelerated central portion and decelerated peripheral portion. FIG. 5 illustrates a flow resistance element which includes a converging-diverging nozzle arrangement constructed as a supersonic diffuser 24. The diffuser 24 transforms the gaseous extinguishing medium from an inlet flow having a substantially uniform velocity profile which is represented by streamlines 13 and which has a velocity that is substantially equally great everywhere, into a downstream flow having a velocity profile 17 with an accelerated central portion and decelerated peripheral portion. The velocity profiles 17 formed by the embodiments illustrated in FIGS. 4 and 5 each include a high velocity core flow and a substantially lower velocity casing flow.

In each of the embodiments of the present invention, the entropy of the core flow generated by the flow resistance element 9 at the outlet of the element 9 is less than the mean entropy over the entire cross-section of the flow at the outlet of the element 9.

When compared to conventional circuit breakers, the present invention provides a lower static pressure in the area of the core flow 18 and a higher static pressure in the area of the casing flow 19 than can be achieved without the flow resistance element 9. This leads to increased Mach numbers in the area of the core flow in comparison to conventional circuit breakers having an equal static pressure. The sonic surfaces 21, 22 are thereby advanced in their respective center areas toward the theoretical stagnation point 20, and the intensity of the shear layer turbulence increased.

Preferably, the outlet of the conical nozzle 10 is sufficiently small so that the shear effects do not severely reduce the velocity in the area of the core flow 18. And preferably, the annular channels 11, 12 are selected such that the separation flow lines between each channel and the nozzle 10 flow downstream in straight lines.

The present invention alters the velocity of the extinguishing medium flow in the vicinity of the theoretical stagnation streamline. The difference between (a) the local velocity at a point on the theoretical stagnation streamline and (b) the mean velocity of the velocity profile development at that point exceeds the corresponding difference at the same point in a circuit breaker without the flow resistance element by at least 10% of the mean velocity at that point with the flow resistance element installed (i.e., (b)). The maximum depth of indentation imposed on the sonic surface by the flow resistance element, when measured parallel to the contact-separation distance, is preferably at least 30%, and most preferably at least 60%, of the diameter of the vertical cross-section of the stream of extinguishing medium flowing parallel to the contact-separation distance at the point at which the sonic surface crosses the axis of the electrical contacts.

Thus, when compared to conventional circuit breakers, the present invention uses a lesser quantity of extinguishing medium to produce a region of supersonic extinguishing medium flow within the contact-separation distance that is at least equal to, and is generally greater than, that achieved in conventional circuit breakers.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Moreover, variations and changes may be made by those skilled in the art without departing from the spirit of the present invention.

What is claimed is:

1. A method for extinguishing the electric arc drawn between a pair of electrical contacts included within a gas-blast circuit breaker as the electrical contacts separate from each other along a common axis during the opening operation of the circuit breaker, said circuit breaker including a hollow body of electrically insulating material having an internal chamber in which said electrical contacts are situated, and having inlet canal means at least partially surrounding the region in which separation of the contacts occurs for introducing gaseous extinguishing medium into the chamber and into the space between the separating electrical contacts, said extinguishing medium being deflected by boundary surfaces defining said chamber so as to be subsequently exhausted from the chamber substantially parallel to said common axis, said method comprising the steps conducting said extinguishing medium into said canal means as said contacts are separated;

producing a variation in the flow resistance across the flow cross-section in said canal means by means of at least one flow resistance element such that the flow resistance in the vicinity of a theoretical stagnation streamline is less than the flow resistance at the inlet of the at least one flow element and such that the difference between the local velocity at a point on the theoretical stagnation streamline and the mean velocity of the velocity profile development at said point exceeds the corresponding difference at the equivalent point in a circuit breaker without said flow resistance element by an amount which is at least ten percent of the mean velocity at said point.

2. The method according to claim 1 wherein the flow velocity distribution produced by said at least one flow resistance element is such that at least one sonic surface extending transversely across said common axis of the electrical contacts is produced in said space between the electrical contacts; the central area of said sonic surface being indented toward the theoretical stagnation point included in said space.

3. The method according to claim 2 wherein the maximum depth of indentation imposed on each of said sonic surfaces, when measured parallel to said common axis, is at least 30% of the diameter of the cross-section of the stream of extinguishing medium flowing parallel to said common axis at the point of maximum sonic surface indentation.

4. The method according to claim 3 wherein the maximum depth of indentation imposed on each of said sonic surfaces, when measured parallel to said common axis, is at least 60% of the diameter of the vertical cross-section of the stream of extinguishing medium flowing parallel to said common axis at the point of maximum sonic surface indentation.

5. An electric gas-blast circuit breaker having a pair of electrical contacts, said contacts being in physical contact with each other when the circuit breaker is in a closed position and said contacts being separated along a common axis by a space when the circuit breaker is not in said closed position, and said circuit breaker having a gaseous extinguishing medium used to extinguish the electric arc drawn between the electrical contacts as the contacts separate from one another during the opening operation of the circuit breaker, said circuit breaker comprising:

a hollow body of electrically insulating material having an internal chamber defined by boundary surfaces in which said electrical contacts are situated;

inlet canal means included on said hollow body at least partially surrounding said space for introducing opposing streams of extinguishing medium into the chamber and into the space between the electrical contacts, said streams of extinguishing medium being deflected by said boundary surfaces so as to be subsequently exhausted from said chamber substantially parallel to said axis; and flow resistance means included in said inlet canal means for altering the flow resistance of said inlet canal means, said flow resistance means having a cross-sectional flow resistance which varies such that the flow resistance in the vicinity of the theoretical stagnation streamline at the outlet of said flow resistance means is less than the flow resistance at the inlet of said flow resistance means.

6. The circuit breaker according to claim 5 wherein said flow resistance means affects the flow of said introduced extinguishing medium over the entire cross-section of said inlet canal means.

7. The circuit breaker according to claim 5 wherein said flow resistance means comprises:

a first means for accelerating at least a portion of said introduced extinguishing medium so as to produce a core flow having a velocity whose magnitude is greater than the mean velocity of the extinguishing medium upstream of said flow resistance means.

8. The circuit breaker according to claim 7 wherein said first means comprises at least one conical nozzle.

9. The circuit breaker according to claim 7 wherein said flow resistance means further comprises:

a second means for decelerating at least a portion of said introduced extinguishing medium so as to produce a casing flow having a velocity whose magnitude is less than the mean velocity of the extinguishing medium upstream of said flow resistance means.

10. The circuit breaker according to claim 9 wherein said second means comprises at least one annular channel coaxially disposed on both lateral sides of said at least one nozzle.

11. The circuit breaker according to claim 9 wherein said first and said second means comprise a plurality of differently-sized nozzle and diffuser elements having varying flow resistances.

12. The circuit breaker according to claim 9 wherein said first means comprises a supersonic diffuser element.

13. The circuit breaker according to claim 5 wherein said flow resistance means is substantially coaxially situated within said inlet canal means, and wherein said inlet canal means has a center line substantially perpendicular to said common axis of the electrical contacts, and wherein said electrical contacts are substantially symmetrically disposed on either side of said center line when the circuit breaker is in an open position.

14. The circuit breaker according to claim 5 wherein said flow resistance means is non-coaxially situated within said inlet canal means, and wherein said inlet canal means has a center line substantially perpendicular to said common axis of the electrical contents, and wherein said electrical contacts are asymmetrically disposed with respect to said center line when the circuit breaker is in an open position, whereby substantially the entire space between the electrical contacts lies within a region of supersonic extinguishing medium flow.

15. The method of claim 2 wherein the flow velocity distribution produced by said at least one flow resistance element is such that first and second sonic surfaces are produced which extend transversely across said common axis on opposite sides of the theoretical stagnation point, the central areas of said sonic surfaces being respectively indented towards the theoretical stagnation point.

* * * * *